US005876519A

United States Patent [19]

Inoue et al.

[11] Patent Number: 5,876,519

[45] Date of Patent: Mar. 2, 1999

[54] FE-BASED AMORPHOUS ALLOY

[75] Inventors: Akihisa Inoue; Akira Murakami, both of Miyagi, Japan

[73] Assignee: Unitika Ltd., Hyogo, Japan

[21] Appl. No.: 818,448

[22] Filed: Mar. 17, 1997

[30] Foreign Application Priority Data

Mar. 19, 1996 [JP] Japan ..... 8-062472

[51] Int. Cl.[6] ..... C22C 45/02

[52] U.S. Cl. ..... 148/304; 148/403; 420/8; 420/99

[58] Field of Search ..... 148/304, 403; 420/8, 99

[56] References Cited

U.S. PATENT DOCUMENTS 4,918,555 4/1990 Yoshizawa et al. ..... 360/125

FOREIGN PATENT DOCUMENTS 56075542 6/1981 Japan .

57202709 12/1982 Japan .

02232301 9/1990 Japan .

402228453 9/1990 Japan .

*Primary Examiner*—Sikyin Ip

*Attorney, Agent, or Firm*—Sughrue, Mion, Zinn, Macpeak & Seas, PLLC

[57] ABSTRACT

An Fe-based amorphous alloy having a compositional formula in atomic percent represented by $Fe_{100-a-b-c-d-e-f}Al_aGa_bP_cC_dB_eSi_f$, wherein a to f satisfy $4 \leqq a \leqq 6$, $1 \leqq b \leqq 3$, $9 \leqq c \leqq 12$, $5 \leqq d \leqq 7$, $3 \leqq e \leqq 5$ and $0.25 \leqq f \leqq 4$. The Fe-based amorphous alloy is an amorphous magnetic material having an excellent amorphous phase-forming ability, and can easily form an amorphous material having a thickness of 1.5 mm or above by a mold casting method realizing a cooling speed of about $10^3$ K/s. Also, because the amorphous alloy has a supercooled liquid region of 50 K or larger, by applying a working method utilizing a super cooled state, amorphous magnetic materials of various form can be prepared.

10 Claims, No Drawings

FE-BASED AMORPHOUS ALLOY

FIELD OF THE INVENTION

The present invention relates to an Fe-based amorphous alloy which has an excellent amorphous phase-forming ability and a wide supercooled liquid region.

BACKGROUND OF THE INVENTION

It is well known that amorphous alloys of various form such as a ribbon, a fine wire, a powder or particle, etc. may be obtained by quenching the alloy in a molten state. Also, hitherto, many amorphous alloys have been identified in Fe-based alloys, Co-based alloys, Ti-based alloys, Zr-based alloys and Al-based alloys. Among these an Fe-based amorphous alloy has excellent soft magnetic characteristics, high strength and good thermal stability. Therefore, Fe-based amorphous alloys have been applied in various industrial fields for use as a transformer material, etc., and have been used to develop new magnetic materials.

However, because a conventional amorphous alloy does not have a sufficient amorphous phase-forming ability and requires a high quenching rate, the use of such a conventional Fe-based amorphous alloy is limited to forming a ribbon having a thickness of 60 $\mu$m or lower, a fine wire having a diameter of 150 $\mu$m or lower, or a powder having a particle size of 100 $\mu$m or lower. As a result, the industrial use thereof has been limited.

On the other hand, JP-A-5-245597 and JP-A-5-253656 (the term "JP-A" as used herein means an "unexamined published Japanese patent application") propose casting method using a mold (hereinafter referred to as a mold casting method), and disclose a method of obtaining a casting of an Fe-based amorphous alloy. However, in the case of using conventional Fe—Si—B based alloys and Fe—P—C based alloys, a thick bulk-form amorphous material is not obtained. This limitation hinders the development of new applications for Fe-based amorphous alloys.

In view of the above, Fe-based alloys having an excellent amorphous phase-forming ability have recently been investigated, and an alloy having the compositional formula $Fe_{72}Al_5Ga_2P_{11}C_6B_4$ which exhibits a wide supercooled liquid region of 50 K or larger has been found as described in *Material Transactions*, JIM, Vol. 36, No. 9, 1180–1183 (1995). This alloy has an excellent amorphous phase-forming ability as well as excellent soft magnetic characteristics and excellent thermal stability, and was therefore expected to provide a functional amorphous alloy bulk material.

However, the present inventors found that when a casting having a thickness of 1.5 mm or above of the foregoing $Fe_{72}Al_5Ga_2P_{11}C_6B_4$ alloy is produced by the mold casting method disclosed in JP-A-5-245597, the amorphous phase-forming ability is insufficient and a casting material having an amorphous single phase is not obtained.

Accordingly, the development of an Fe-based amorphous alloy having a superior amorphous phase-forming ability which can be produced in a bulk-form having a thickness of 1.5 mm or above has been desired. Also, in order not to reduce its workability, the amorphous alloy should have a wide supercooled liquid region of 50 K or larger in addition to an excellent amorphous phase-forming ability. From this view point, the development of an Fe-based amorphous alloy having an amorphous phase-forming ability that is superior to that of the $Fe_{72}Al_5Ga_2P_{11}C_6B_4$ alloy and a wide supercooled liquid region has been desired.

SUMMARY OF THE INVENTION

Accordingly, an object of the present invention is to provide an Fe-based amorphous alloy having an excellent amorphous phase-forming ability and a wide supercooled liquid region of 50 K or larger.

As the result of various investigations directed towards solving the above problem, the present inventors discovered that by adding a specific amount of Si to an Fe—Al—Ga—P—C—B-based alloy having a specific composition, an Fe-based amorphous alloy having an amorphous phase-forming ability superior to that of the $Fe_{72}Al_5Ga_2P_{11}C_6B_4$ alloy and a supercooled liquid region of 50 K or larger can be obtained to thereby achieve the present invention.

That is, the present invention provides an Fe-based amorphous alloy having a compositional formula in atomic percent represented by $Fe_{100-a-b-c-d-e-f}Al_aGa_bP_cC_dB_eSi_f$, wherein a to f satisfy $4 \leqq a \leqq 6$, $1 \leqq b \leqq 3$, $9 \leqq c \leqq 12$, $5 \leqq d \leqq 7$, $3 \leqq e \leqq 5$ and $0.25 \leqq f \leqq 4$.

The Fe-based amorphous alloy of the present invention is an amorphous magnetic material having an excellent amorphous phase-forming ability. Furthermore, by utilizing a mold casting method, etc., an amorphous alloy having a thickness of 1.5 mm or thicker can easily be prepared from the Fe-based amorphous alloy.

Also, the Fe-based amorphous alloy of this invention has a supercooled liquid region of 50 K or larger. Therefore, by applying a working method utilizing a super cooled state, amorphous magnetic materials having various forms are obtained, and the Fe-based amorphous alloy of this invention has a high practical utility as an industrial material.

DETAILED DESCRIPTION OF THE INVENTION

The present invention is described in detail below.

In the present invention, in order to obtain an Fe-based amorphous alloy having an excellent amorphous phase-forming ability and a supercooled liquid region of 50 K or larger, the composition range of each alloy element of the Fe—Al—Ga—P—C—B—Si alloy is specified as follows.

That is, in the Fe-based amorphous alloy of the present invention, the Al content is from 4 atomic percent to 6 atomic percent and is preferably from 4.5 atomic percent to 5.5 atomic percent. When the Al content is less than 4 atomic percent or over 6 atomic percent, the amorphous phase-forming ability is reduced and even by using a mold casting method, an amorphous single phase is not obtained in a casting having a thickness of 1.5 mm or above.

Also, the Ga content is from 1 atomic percent to 3 atomic percent, and preferably from 1.5 atomic percent to 2.5 atomic percent. If the Ga content is less than 1 atomic percent or over 3 atomic percent, the amorphous phase-forming ability is reduced and even by using a mold casting method, an amorphous single phase is not obtained in a casting having a thickness of 1.5 mm or above.

Furthermore, in the Fe-based amorphous alloy of the present invention, the P content is from 9 atomic percent to 12 atomic percent, and preferably from 10 atomic percent to 11 atomic percent. When the P content is less than 9 atomic percent or over 12 atomic percent, the amorphous phase-forming ability is reduced and even by using a mold casting method, an amorphous single phase is not obtained in a casting having a thickness of 1.5 mm or above.

Also, the C content is from 5 atomic percent to 7 atomic percent, and preferably from 5.5 atomic percent to 6.5 atomic percent. When the C content is less than 5 atomic percent or over 7 atomic percent, the amorphous phase-forming ability is reduced and even by using a mold casting method, an amorphous single phase is not obtained in a casting having a thickness of 1.5 mm or above.

Furthermore, in the Fe-based amorphous alloy of the present invention, the B content is from 3 atomic percent to 5 atomic percent, and preferably from 3.5 atomic percent to 4.5 atomic percent. When the B content is less than 3 atomic percent or over 5 atomic percent, the amorphous phase-forming ability is reduced and even by using a mold casting method, an amorphous single phase is not obtained in a casting having a thickness of 1.5 mm or above.

Also, the Si content is from 0.25 atomic percent to 4 atomic percent, and preferably from 0.5 atomic percent to 3 atomic percent. When the Si content is less than 0.25 atomic percent or over 4 atomic percent, the amorphous phase-forming ability is reduced and even by using a mold casting method, an amorphous single phase is not obtained in a casting having a thickness of 1.5 mm or above.

In addition, the Fe-based amorphous alloy of the present invention may contain not more than 5 atomic percent of Co, Cr, Mo and Nb as additional elements in a range such that the effects of the invention are obtained.

The Fe-based amorphous alloy of the present invention has an excellent amorphous phase-forming ability and can readily provide an amorphous material having a thickness of 1.5 mm or above in a mold casting method realizing a cooling speed of about $10^3$ K/s. In the case of using a mold casting method, after melting the alloy in a quartz nozzle having an orifice diameter of from 0.5 mm to 1.0 under a vacuum or in an argon atmosphere, the molten alloy is ejected in a copper-made mold at an ejection pressure of from 0.1 to 2.0 kg/cm$^2$ and solidified in the mold. As a result, an amorphous bulk material having a casting thickness of 1.5 mm or above is readily obtained.

Also, the amorphous alloy of the present invention has a supercooled liquid region of 50 K or larger, and has an excellent workability in a super cooled liquid state.

The supercooled liquid region in the present invention is defined by the difference (Tx−Tg) of the glass transition temperature (Tg) and the crystallization temperature (Tx) obtained by a differential scanning calorimetric analysis when temperature is increased at a rate of from 20 to 40 K/minute.

The Fe-based amorphous alloy of the present invention is a magnetic material having a saturated magnetic flux density of 0.9 T or higher. Furthermore, by heat treating for a time period which does not cause crystallization in a temperature range of from 300° to 460° C., a material having excellent soft magnetic characteristics can be obtained.

Furthermore, because the Fe-based amorphous alloy of the present invention has an excellent amorphous phase-forming ability, the Fe-based amorphous alloy is easily produced using a conventional melt-quenching method of high productivity such as a single roller melt-spinning method, a twin roller melt-spinning method, an In-rotating water spinning method, a gas atomizing method, etc.

For example, in a single roller melt-spinning method which is a typical method for producing an amorphous alloy, after melting the alloy in a quartz nozzle under an argon atmosphere, the molten alloy is ejected onto a copper roller having a diameter of about 20 cm rotating at a speed of from 1,000 to 4,000 rpm in vacuum or under an argon atmosphere. For this purpose, a quartz-made nozzle is used having an orifice diameter of from 0.1 to 1.0 mm at a spraying pressure of from 0.1 to 2.0 kg/cm$^2$. Thus, the alloy is solidified by ejection, to thereby obtain an Fe-based amorphous alloy.

The practical details of the present invention are explained by reference to the following Examples, however, the present invention should not be construed as being limited thereto.

EXAMPLES 1 to 12 and COMPARATIVE EXAMPLES (1) to (12)

After melting each alloy having the compositions shown in Table 1 below in a quartz nozzle having an orifice diameter of 0.5 mm, the molten alloy was ejected into a copper mold under an argon reduced-pressure atmosphere at an ejection pressure of 0.5 kg/cm$^2$. The alloy was then solidified by quenching to prepare a cylindrical sample having a diameter of 1.5 mm and a height of 50 mm.

Then, for each sample thus prepared, the structure and temperature width (ΔTx) of the supercooled liquid region were determined. With regard to structure, a sample exhibiting only a broad diffraction peak specific to an amorphous phase as determined by an X-ray diffraction method was identified as being an amorphous structure, and a sample in which an amorphous phase and a crystalline phase were found to co-exist was identified as being a crystalline structure.

The temperature width (ΔTx) of the supercooled liquid region was determined as the difference (Tx−Tg) of the glass transition temperature (Tg) and the crystallization temperature (Tx) obtained by a differential scanning calorimetric analysis at a heating rate of 40 K/minute. The temperature width (ΔTx) of crystalline samples was not measured.

The temperature width (ΔTx) of the supercooled liquid region of the samples thus prepared and the structure thereof are shown in Table 1 below.

TABLE 1

| | Alloy Composition (atomic percent) | | | | | | | ΔTx | |
|---|---|---|---|---|---|---|---|---|---|
| | Fe | Al | Ga | P | C | B | Si | (K) | (A)* |
| 1 | 71.5 | 5 | 2 | 11 | 6 | 4 | 0.5 | 57 | amo. |
| 2 | 71 | 5 | 2 | 11 | 6 | 4 | 1 | 56 | amo. |
| 3 | 69 | 5 | 2 | 11 | 6 | 4 | 3 | 57 | amo. |
| 4 | 72 | 5 | 2 | 10 | 6 | 4 | 1 | 55 | amo. |
| 5 | 71 | 4.5 | 2 | 11 | 6 | 4 | 1.5 | 56 | amo. |
| 6 | 71 | 5.5 | 2 | 10.5 | 6 | 4 | 1 | 54 | amo. |
| 7 | 71 | 5 | 2 | 10.5 | 6 | 4.5 | 1 | 56 | amo. |
| 8 | 72 | 5 | 2 | 10.5 | 6 | 3.5 | 1 | 55 | amo. |
| 9 | 71.5 | 5 | 2 | 11 | 5.5 | 4 | 1 | 57 | amo. |
| 10 | 71 | 5 | 2 | 11 | 6.5 | 3.5 | 1 | 54 | amo. |
| 11 | 71.5 | 5 | 1.5 | 11 | 6 | 4 | 1 | 55 | amo. |
| 12 | 71.5 | 5 | 2.5 | 10 | 6 | 4 | 1 | 56 | amo. |
| (1) | 72 | 5 | 2 | 11 | 6 | 4 | 0 | — | cry. |
| (2) | 67 | 5 | 2 | 11 | 6 | 4 | 5 | — | cry. |
| (3) | 72 | 3 | 2 | 11 | 6 | 4 | 2 | — | cry. |
| (4( | 68 | 7 | 2 | 11 | 6 | 4 | 2 | — | cry. |
| (5) | 72 | 5 | 0 | 11 | 6 | 4 | 2 | — | cry. |
| (6) | 69 | 5 | 4 | 11 | 6 | 4 | 1 | — | cry. |
| (7) | 73 | 5 | 2 | 8 | 6 | 4 | 2 | — | cry. |
| (8) | 69 | 5 | 2 | 13 | 6 | 4 | 1 | — | cry. |
| (9) | 72 | 5 | 2 | 11 | 4 | 4 | 2 | — | cry. |
| (10) | 70 | 5 | 2 | 10 | 8 | 4 | 1 | — | cry. |
| (11) | 72 | 5 | 2 | 11 | 6 | 2 | 2 | — | cry. |
| (12) | 71 | 5 | 2 | 10 | 5 | 6 | 1 | — | cry. |

In the above Table:
(A)*: Structure,
amo.: Amorphous structure,
cry.: Crystalline structure,
1 to 12: Examples of this invention, and (1) to (12): Comparative Examples.

As shown Table 1 above, in each of Examples 1 to 12 of the present invention, a cylindrical sample made of an amorphous single phase having a diameter of 1.5 mm and a height of 50 mm was prepared.

Also, with regard to the temperature region where an alloy can exist as a super cooled liquid, that is, the supercooled liquid region, each of the alloys in the examples of the present invention was an amorphous alloy having a very wide supercooled liquid temperature region of 50 K or larger.

On the other hand, each of the alloys of Comparative Examples (1) to (12) having a composition outside the scope of the present invention did not have a sufficient amorphous phase-forming ability. Furthermore, in the case of using a mold casting method, each cylindrical sample having a diameter of 1.5 mm contained a crystalline phase, and in the Comparative Examples, an amorphous single phase alloy could not be prepared.

EXAMPLE 13

After melting an alloy having the composition $Fe_{72}Al_5Ga_2P_{10}C_6B_4Si_1$ in a quartz-made nozzle having an orifice diameter of 0.5 mm, the molten alloy was ejected into a copper mold under an argon atmosphere at an ejection pressure of 0.5 kg/cm$^2$. The alloy was solidified by quenching to prepare a cylindrical sample having a diameter of 2 mm and a height of 50 mm. Then, as in Examples 1 to 12, the structure and temperature width of the supercooled liquid region were measured.

The results showed that the cylindrical sample having a diameter of 2 mm thus prepared was made of an amorphous single phase, and the temperature width of the supercooled liquid region had a wide temperature range of 58 K.

While the invention has been described in detail and with reference to specific embodiments thereof, it will be apparent to one skilled in the art that various changes and modifications can be made therein without departing from the spirit and scope thereof.

What is claimed is:

1. An Fe-based amorphous alloy consisting essentially of a compositional formula in atomic percent represented by $Fe_{100-a-b-c-d-e-f}Al_aGa_bP_cC_dB_eSi_f$, wherein a to f satisfy $4 \leqq a \leqq 6$, $1 \leqq b \leqq 3$, $9 \leqq c \leqq 12$, $5 \leqq d \leqq 7$, $3 \leqq e \leqq 5$ and $0.25 \leqq f \leqq 4$, said alloy having a supercooled liquid region of 50 K or larger, and wherein a casting of said alloy having a thickness of 1.5 mm or above has an amorphous single phase.

2. The Fe-based amorphous alloy of claim 1, wherein a is from 4.5 to 5.5 atomic percent, b is from 1.5 to 2.5 atomic percent, c is from 10 to 11 atomic percent, d is from 5.5 to 6.5 atomic percent, e is from 3.5 to 4.5 atomic percent and f is from 0.5 to 3 atomic percent.

3. The Fe-based amorphous alloy of claim 2 having an amorphous single phase.

4. The Fe-based amorphous alloy of claim 2 in the form of a casting having an amorphous single phase and a thickness of 1.5 mm or above.

5. The Fe-based amorphous alloy of claim 4 prepared by a mold casting method.

6. The Fe-based amorphous alloy of claim 2, wherein said Fe-based amorphous alloy is produced by a melt-quenching method.

7. The Fe-based amorphous alloy of claim 1 having an amorphous single phase.

8. The Fe-based amorphous alloy of claim 1 in the form of a casting having an amorphous single phase and a thickness of 1.5 mm or above.

9. The Fe-based amorphous alloy of claim 8 prepared by a mold casting method.

10. The Fe-based amorphous alloy of claim 1, wherein said Fe-based amorphous alloy is produced by a melt-quenching method.

* * * * *